US012624831B2

(12) United States Patent
Chen

(10) Patent No.: US 12,624,831 B2
(45) Date of Patent: May 12, 2026

(54) BURNER ASSEMBLY FOR AIR PREHEATING COMBUSTION

(71) Applicant: Xiong Chen, Songzi (CN)

(72) Inventor: Xiong Chen, Songzi (CN)

( * ) Notice: Subject to any disclaimer, the term of this patent is extended or adjusted under 35 U.S.C. 154(b) by 0 days.

(21) Appl. No.: 19/019,537

(22) Filed: Jan. 14, 2025

(65) Prior Publication Data

US 2026/0049713 A1 Feb. 19, 2026

(30) Foreign Application Priority Data

Aug. 17, 2024 (CN) ..... 202411131310.7

(51) Int. Cl.
*F23D 14/66* (2006.01)
*F24H 9/00* (2022.01)

(52) U.S. Cl.
CPC ..... *F23D 14/66* (2013.01); *F24H 9/0084* (2013.01)

(58) Field of Classification Search
CPC ..... F23D 14/66; F24H 9/0084
See application file for complete search history.

(56) References Cited

U.S. PATENT DOCUMENTS 2,110,841 A * 3/1938 Maier ..... F24H 9/02 220/684
2,299,154 A * 10/1942 Lair ..... F24H 9/1836 126/145
4,736,730 A * 4/1988 Robertson ..... F24B 7/005 237/55
5,176,512 A * 1/1993 Evens ..... F23D 14/045 431/286
5,392,761 A * 2/1995 Swilik, Jr. ..... F24H 3/105 126/110 A
5,797,386 A * 8/1998 Orr ..... A47J 37/0763 126/25 R
7,013,841 B1 * 3/2006 Boros ..... F24H 1/205 122/19.2
2001/0027756 A1 * 10/2001 Vago ..... F23D 14/66 122/18.2

(Continued)

FOREIGN PATENT DOCUMENTS

AT 393159 B * 8/1991
AT 403092 B * 9/1997 ..... F24H 9/0026

(Continued)

*Primary Examiner* — Michael G Hoang
*Assistant Examiner* — Logan P Jones
(74) *Attorney, Agent, or Firm* — Hemisphere Law, PLLC

(57) ABSTRACT

A burner assembly for air preheating combustion includes a combustion chamber and a metal box. A heat exchanger is disposed on a top of the combustion chamber, and a burner is disposed on a bottom of the combustion chamber. The metal box is disposed outside the combustion chamber and a preheating channel is defined between the metal box and the combustion chamber. Each side of the metal box defines multiple ventilation holes uniformly arranged on an upper end of each side of the metal box. A bottom end of the metal box is provided with a sealing baffle, the burner assembly guides outside air to pass through the multiple ventilation holes, then enter the preheating channel, and reach at an inner side of the sealed baffle to complete air movement from top to bottom, and guide the air move from bottom to top to thereby enter the combustion chamber.

6 Claims, 4 Drawing Sheets

(56) References Cited

U.S. PATENT DOCUMENTS

| | | | | |
|---|---|---|---|---|
| 2010/0065046 | A1* | 3/2010 | Juanico | F23L 17/04<br>126/307 A |
| 2012/0060819 | A1* | 3/2012 | Hunt | A47J 36/2477<br>220/573.1 |
| 2013/0047689 | A1* | 2/2013 | Sutherland | B21D 39/03<br>72/46 |

FOREIGN PATENT DOCUMENTS

| | | | | |
|---|---|---|---|---|
| DE | 19950997 | A1 * | 5/2001 | F23D 14/66 |
| GB | 191004723 | A * | 1/1911 | |
| GB | 2512417 | A * | 10/2014 | F24B 1/00 |
| SU | 1112180 | A1 * | 9/1984 | |

* cited by examiner

BURNER ASSEMBLY FOR AIR PREHEATING COMBUSTION

CROSS-REFERENCE TO RELATED APPLICATION

This application claims priority to Chinese patent application No. CN 202411131310.7, filed to China National Intellectual Property Administration (CNIPA) on Aug. 17, 2024, which is herein incorporated by reference in its entirety.

TECHNICAL FIELD

The disclosure relates to the technical field of high-efficiency air preheating and enhanced combustion water heaters, and particularly to a burner assembly for air preheating combustion.

BACKGROUND

Currently, there are two types of air intake methods as follows for combustion air required by water heaters. The first type is an upward suction fan located above a heat exchanger, and the air, which is natural air-cooled air below a burner, required for the combustion is directly drawn into a combustion chamber. The second type is a downward blower located below the burner, and the air, which is natural air-cooled air, required for the combustion is blown into the combustion chamber by the fan.

Both above methods involve air at an ambient temperature for the combustion, with air temperatures generally ranging from −10 degrees Celsius (° C.) to 35° C. Inhaling a large amount of the cold air increases an energy loss of the combustion and can only meet needs of natural combustion without achieving the effect of intensified combustion. Therefore, a burner assembly for high-efficient air preheating combustion is proposed to solve the above problems.

SUMMARY

The disclosure provides a burner assembly for high-efficient air preheating combustion, which improves combustion heating efficiency while making combustion more stable.

The technical solutions of the disclosure are as follows.

A burner assembly for high-efficient air preheating combustion includes a combustion chamber and a metal box. A heat exchanger is disposed on a top of the combustion chamber, and a burner is disposed on a bottom of the combustion chamber. The metal box is disposed outside the combustion chamber and a preheating channel is defined between the metal box and an outside of the combustion chamber. Each of four sides of the metal box defines multiple ventilation holes uniformly arranged on an upper end of each of the four sides of the metal box. A bottom end of the metal box is provided with a sealing baffle, the burner assembly is configured to: guide outside air to first pass through the multiple ventilation holes, then enter the preheating channel, and reach at an inner side of the sealed baffle to complete air movement from top to bottom, and guide the air move from bottom to top to thereby enter the combustion chamber.

In an embodiment, a lower side of the burner is provided with a metal baffle, and a hot air return compartment is defined between the sealing baffle and the metal baffle and is connected to the preheating channel. The metal baffle defines multiple air inlet holes, and the multiple air inlet holes is configured to allow a preheated air entering the hot air return compartment to pass through the multiple air inlet holes and disperse from the preheated air to make the preheated air enter the combustion chamber from bottom to top.

In an embodiment, each of the multiple ventilation holes is a rectangular ventilation hole.

In an embodiment, side walls of the metal box and side walls of the combustion chamber are respectively connected by a screw locking manner.

In an embodiment, a heat absorbing sheet of the heat exchanger is mounted on an upper part of the combustion chamber, and an outer side of the heat absorbing sheet abuts against an inner wall of the combustion chamber.

In an embodiment, the bottom end of the metal box is provided with folded edges, and the folded edges defines threaded holes thereon. The sealing baffle is threadedly connected to the folded edges on the metal box through bolts.

Compared to the related art, the technical solution of the disclosure has the following beneficial effects as follows. By setting up a preheating channel, the cold air from the outside can be preheated by the temperature of the combustion chamber before entering it. The preheated air, after passing through the air inlet holes defined on the metal baffle, enters the combustion chamber to enhance combustion. The high-temperature air, after preheating, will first pass through the burner when entering the combustion chamber, a metal mixer throat of the burner is preheated to heat the gas, which allows the gas to be preheated and thus further improves the thermal efficiency of the combustion. In addition, it makes the combustion more stable.

DESCRIPTION OF REFERENCE NUMERALS

Figure 1:
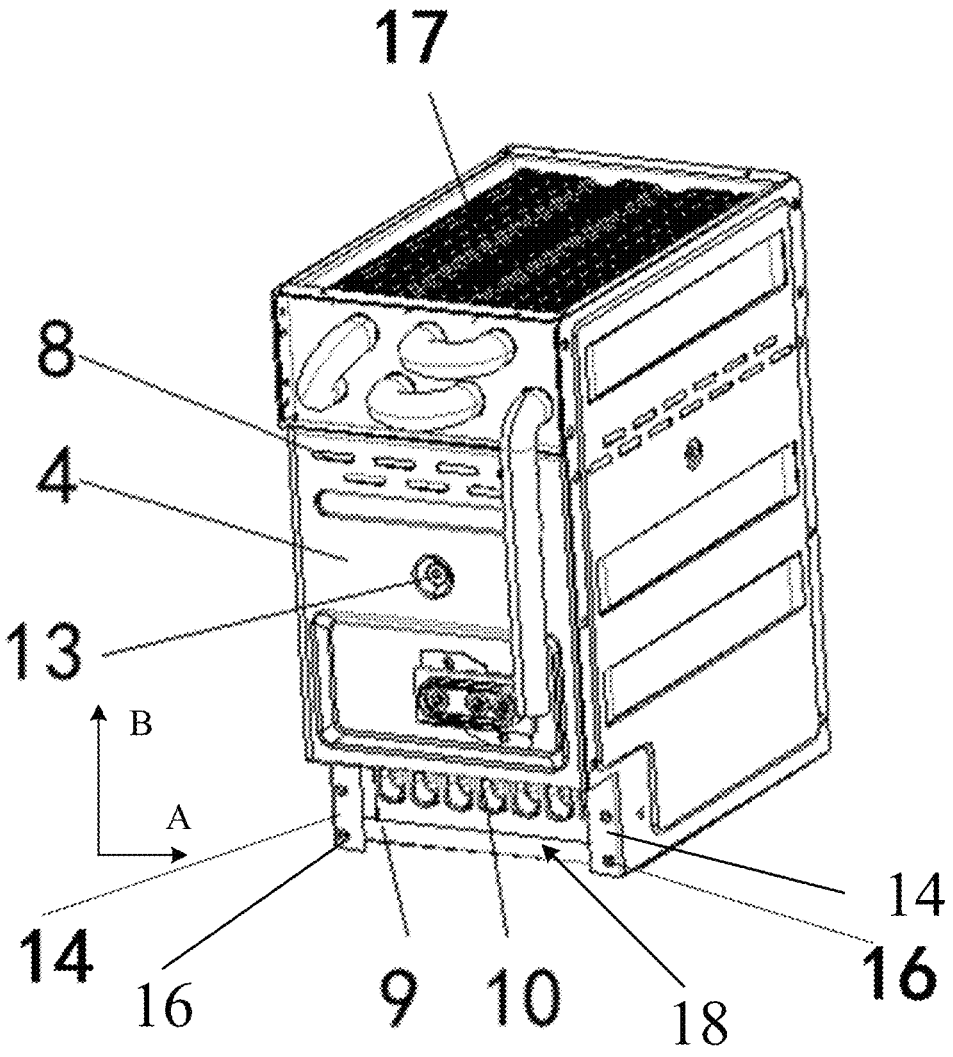
FIG. 1 illustrates a schematic diagram of the disclosure.

1. combustion chamber; 2. heat exchanger; 3. burner; 4. metal box; 5. preheating channel; 6. metal baffle; 7. air inlet hole; 8. ventilation hole; 9. sealing baffle; 10. metal throat pipe; 11. hot air return compartment; 12. first screw connection hole; 13. second screw connection hole; 14. first folded edge; 15. threaded hole; 16. bolt; 17. heat absorbing sheet; 18. second folded edge; A. first direction, B. second direction.

DETAILED DESCRIPTION OF EMBODIMENTS

The disclosure will provide a clear and complete description of the technical solution in the embodiments of the disclosure, in conjunction with the attached drawings.

As shown in FIGS. 1-6, a burner assembly for high-efficient air preheating combustion includes a combustion chamber 1 and a metal box 4. A heat exchanger 2 is disposed on a top of the combustion chamber 1, a burner 3 is disposed on a bottom of the combustion chamber 1, the burner 3 is provided with a metal throat pipe 10 configured to connect with gas. The metal box 4 is disposed outside the combustion chamber 1 and a preheating channel 5 is defined between the metal box 4 and an outside of the combustion chamber 1. Each of four sides of the metal box 4 defines multiple ventilation holes 8 uniformly arranged on an upper end of each of the four sides of the metal box 4. Each of the multiple air inlet holes 8 is a rectangular air inlet hole 8. A bottom end of the metal box 4 is provided with a sealing baffle 9, the burner assembly is configured to: guide outside air to first pass through the plurality of ventilation holes 8, then enter the preheating channel 5, and reach at an inner side of the sealed baffle 9 to complete air movement from top to bottom, and guide the air move from bottom to top to thereby enter the combustion chamber 1.

In order to disperse the hot air to flow upwards, the metal baffle 6 is disposed on a lower side of the burner 3. A hot air return compartment 11 connected to the preheating channel 5 is defined between the sealed baffle 9 and the metal baffle 6. The metal baffle 6 defines multiple air inlet holes 7, and the multiple air inlet holes 7 is configured to allow a preheated air entering the hot air return compartment 11 to pass through the multiple air inlet holes 7 and disperse the preheated air to make the preheated air enter the combustion chamber 1 from bottom to top.

To facilitate the upward flow of the gas within the combustion chamber 1, a blower is disposed at the top of the combustion chamber 1. The blower provides a power for outside air to first pass through the multiple ventilation holes 8, then enter the preheating channel 5, and reach at an inner side of the sealed baffle 9 to complete air movement from top to bottom, and guide the air move from bottom to top through the metal baffle 6 to thereby enter the combustion chamber 1.

To fixedly dispose the combustion chamber 1 inside the metal box 4, side walls of the metal box 4 and side walls of the combustion chamber 1 are respectively connected by a screw locking manner.

Specifically, the metal box 4 defines first screw connection holes 12 on the side walls of the metal box 4, and the combustion chamber 1 correspondingly defines second screw connection holes 13 on side walls of the combustion chamber 1.

In an illustrated embodiment, when a water heating fan initiates the combustion, the hot gas inside the combustion chamber 1 is expelled from bottom to top. Since the combustion chamber 1 is suspended inside the metal box 4 with the bottom of the metal box 4 being sealed, outside cold air enters from the top down through the air inlet holes 8 of the metal box 4 into the preheating channel 5, where it is preheated by the combustion temperature of the combustion chamber 1. The preheated air is then transported to the hot air return compartment 11. After being blocked by the sealed baffle 9, the preheated air is transmitted upwards, first dispersing through the air inlet holes 7 on the metal baffle 6, and then entering the combustion chamber 1 to enhance the combustion. During the process of the preheated air entering the combustion chamber 1 from the bottom up, it comes into contact with the burner 3, preheating the gas inside the burner 3, thereby further improving the combustion and heat generation efficiency.

In an embodiment, a heat absorbing sheet 17 of the heat exchanger 2 is mounted on an upper part of the combustion chamber 1, and an outer side of the heat absorbing sheet 17 abuts against an inner wall of the combustion chamber 1. The metal box 4 and the combustion chamber 1 define mounting holes that are compatible with pipes of the heat exchanger 2. The pipes of the heat exchanger 2 extend outside the metal box 4 through the mounting holes.

In an embodiment, the heat exchanger 2 can be directly placed on the upper part of the combustion chamber 1, which is easy to assemble and disassemble for maintenance.

Figure 2:
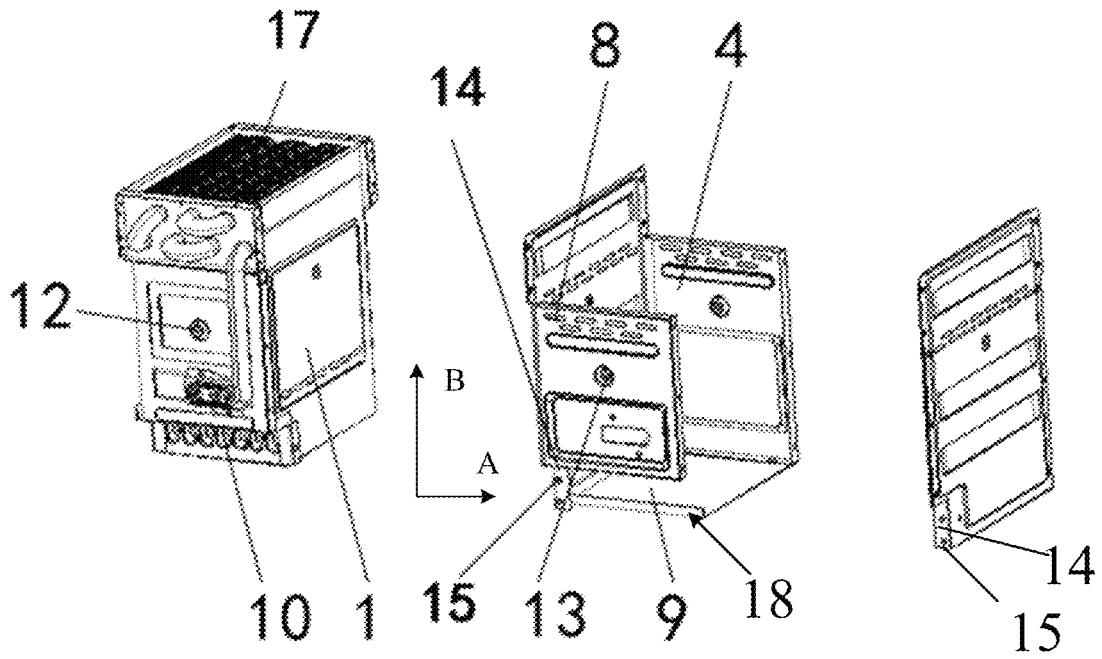
FIG. 2 illustrates an exploded structure diagram of the disclosure.
Figure 3:
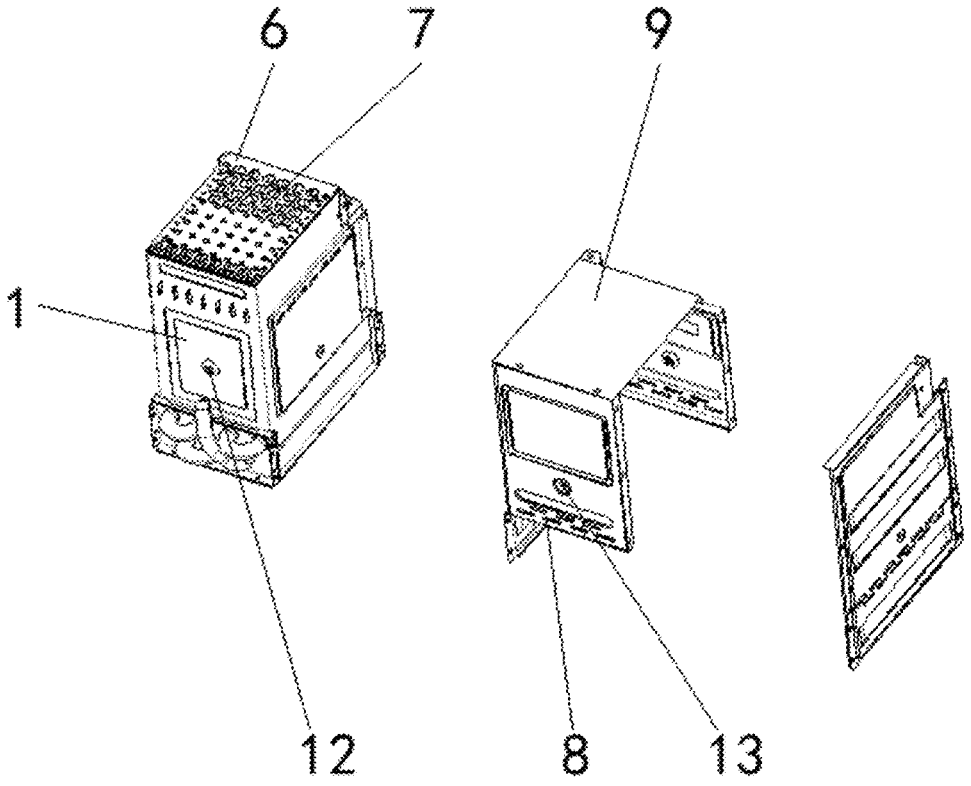
FIG. 3 illustrates a top view of the exploded structure diagram of the disclosure.
Figure 4:
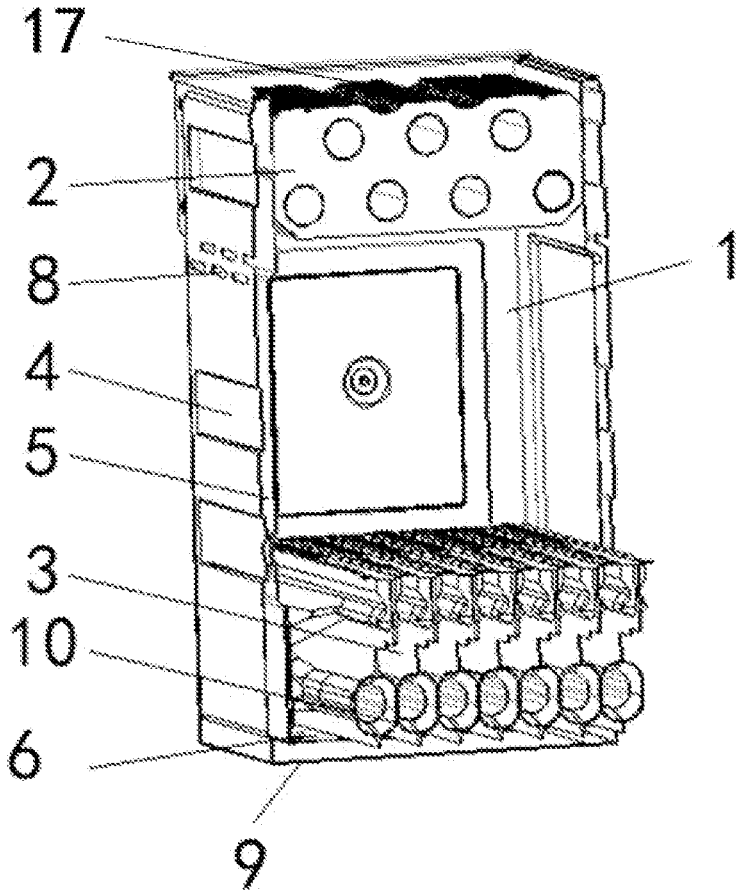
FIG. 4 illustrates a sectional structure diagram of the disclosure.
Figure 5:
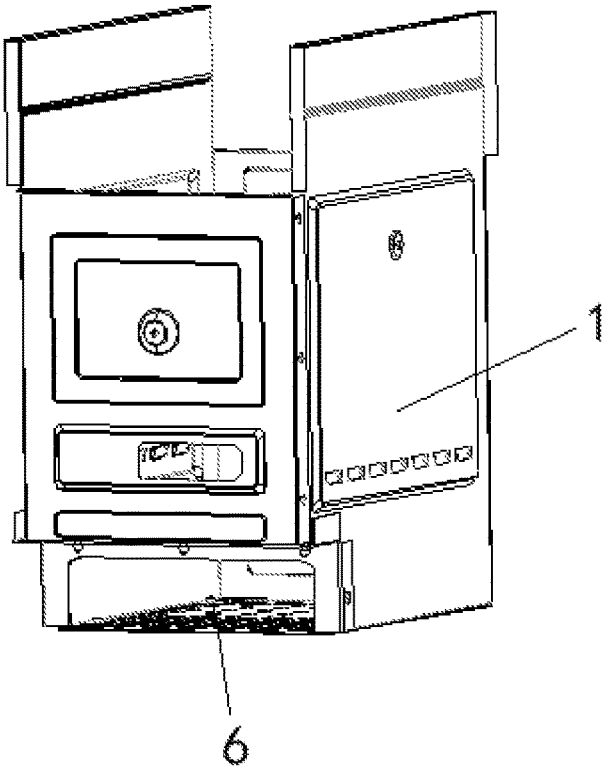
FIG. 5 illustrates a schematic diagram of a combustion chamber connected to a metal baffle of the disclosure.
Figure 6:
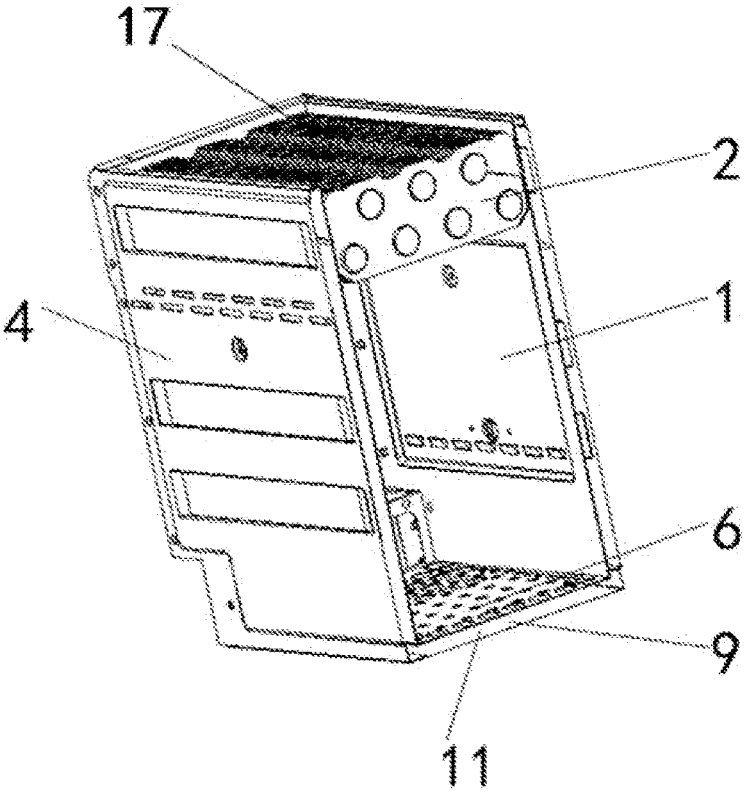
FIG. 6 illustrates a schematic diagram of a hot air return compartment of the disclosure.

In an embodiment, as shown in FIG. 1 and FIG. 2, the bottom end of the metal box extends in a first direction A to form first folded edges 14, and the first folded edges 14 define threaded holes 15 thereon. The sealing baffle 9 extends in a second direction B to form a second folded edge 18. The first direction A is different from the second direction B. The second folded edge 18 of the sealing baffle 9 is threadedly connected to the folded edges 14 on the metal box 4 through bolts 16.

In an illustrated embodiment, the sealing baffle 9 is configured to block the preheated air, allowing it to return to the combustion chamber 1.

Although the embodiments of the disclosure have been shown and described, it will be understood by those skilled in the art that various changes, modifications, substitutions, and variations can be made to these embodiments without departing from the principles and spirit of the disclosure. The scope of the disclosure is limited by the appended claims and their equivalents.

What is claimed is:

1. A burner assembly for air preheating combustion, comprising a combustion chamber (1) and a metal box (4), wherein a heat exchanger (2) is disposed on a top of the combustion chamber (1), a burner (3) is disposed on a bottom of the combustion chamber (1), the burner (3) is provided with a metal throat pipe (10), and the metal throat pipe (10) is configured to receive gas from outside and transmit the gas into the burner (3);

wherein the metal box (4) is disposed outside the combustion chamber (1) and a preheating channel (5) is defined between the metal box (4) and the combustion chamber (1); each of four sides of the metal box (4) defines a plurality of ventilation holes (8) uniformly arranged on an upper end of each of the four sides of the metal box (4); a bottom end of the metal box (4) is provided with a sealing baffle (9), a bottom of the burner (3) is provided with a metal baffle (6), and a hot air return compartment (11) is defined between the sealing baffle (9) and the metal baffle (6) and is connected to the preheating channel (5); and the metal baffle (6) defines a plurality of air inlet holes (7);

wherein the burner assembly is configured to: when the burner assembly is operated, guide air from outside of the burner assembly to first pass through the plurality of ventilation holes (8), then enter the preheating channel (5) to make the air be preheated to thereby obtain preheated air, and guide the preheated air to reach at the hot air return compartment (11) to complete air movement from top to bottom; and make the preheated air be in contact with the burner (3) via the plurality of air inlet holes (7) to preheat the gas in the burner (3), and guide the preheated air to enter the combustion chamber (1) for enhancing combustion, thereby to complete the air movement from bottom to top; and wherein the bottom end of the metal box (4) extends in a first direction (A) to form first folded edges (14), the first folded edges (14) define threaded holes (15) thereon, the sealing baffle (9) extends in a second direction (B) to form a second folded edge (18), the first direction (A) is different from the second direction (B), and the second folded edge (18) of the sealing baffle (9) is threadedly connected to the first folded edges (14) on the metal box (4) through bolts (16).

2. The burner assembly for air preheating combustion as claimed in claim 1, wherein each of the plurality of ventilation holes (8) is a rectangular ventilation hole (8).

3. The burner assembly for air preheating combustion as claimed in claim 1, wherein side walls of the metal box (4) and side walls of the combustion chamber (1) are respectively connected by a screw locking manner.

4. The burner assembly for air preheating combustion as claimed in claim 1, wherein a heat absorbing sheet (17) of the heat exchanger (2) is mounted on an upper part of the combustion chamber (1), and an outer side of the heat absorbing sheet (17) abuts against an inner wall of the combustion chamber (1).

5. The burner assembly for air preheating combustion as claimed in claim 1, wherein a blower is disposed at the top of the combustion chamber (1), and the blower is configured to provide a power for the air movement from top to bottom and the air movement from bottom to top.

6. The burner assembly for air preheating combustion as claimed in claim 1, wherein the air flowing downwardly within the preheating channel (5) is preheated by a combustion temperature of the combustion chamber (1) before the air enters the combustion chamber (1).

* * * * *